US007934754B2

(12) United States Patent
Mathachan

(10) Patent No.: US 7,934,754 B2
(45) Date of Patent: May 3, 2011

(54) DOOR LOCK ASSEMBLY

(75) Inventor: Sajil J. Mathachan, Dharwad (IN)

(73) Assignee: Schlage Lock Company, Carmel, IN (US)

( * ) Notice: Subject to any disclaimer, the term of this patent is extended or adjusted under 35 U.S.C. 154(b) by 36 days.

(21) Appl. No.: 11/849,575

(22) Filed: Sep. 4, 2007

(65) Prior Publication Data

US 2009/0056391 A1 Mar. 5, 2009

(51) Int. Cl.
*E05B 1/00* (2006.01)

(52) U.S. Cl. ..... 292/347; 292/336.3; 292/336.5

(58) Field of Classification Search ..... 292/336.3, 292/336.5, 347; 70/224, 223, 209
See application file for complete search history.

(56) References Cited

U.S. PATENT DOCUMENTS

| | | | | |
|---|---|---|---|---|
| 2,739,472 | A | 3/1956 | North et al. | |
| 2,814,194 | A | 11/1957 | North et al. | |
| 2,950,615 | A | 8/1960 | Schlage et al. | |
| 3,819,214 | A | 6/1974 | Hart et al. | |
| 4,470,278 | A | 9/1984 | Hale et al. | |
| 4,838,053 | A | 6/1989 | Shen | |
| 4,966,399 | A * | 10/1990 | Lin | 292/359 |
| 5,284,372 | A * | 2/1994 | Lin | 292/336.3 |
| 5,301,526 | A | 4/1994 | Fann et al. | |
| 5,460,417 | A | 10/1995 | Zuckerman | |
| 5,784,909 | A * | 7/1998 | Huang | 70/224 |
| 5,816,086 | A | 10/1998 | Russell, IV | |
| 5,941,108 | A | 8/1999 | Shen | |
| 5,992,189 | A | 11/1999 | McCaa | |
| 6,021,654 | A * | 2/2000 | McCaa | 70/149 |
| 6,038,894 | A * | 3/2000 | Hu | 70/224 |
| 6,141,998 | A * | 11/2000 | Seo | 70/224 |
| 6,216,500 | B1 * | 4/2001 | Kang | 70/224 |
| 6,279,360 | B1 * | 8/2001 | Shen | 70/224 |
| 6,351,976 | B1 * | 3/2002 | Chen | 70/224 |
| 6,357,270 | B1 * | 3/2002 | Vazquez | 70/472 |
| 6,425,273 | B1 | 7/2002 | Kim et al. | |

(Continued)

FOREIGN PATENT DOCUMENTS

WO 9806916 A 2/1998

OTHER PUBLICATIONS

Pending U.S. Appl. No. 11/849,620, filed Sep. 4, 2007.

(Continued)

*Primary Examiner* — Carlos Lugo
*Assistant Examiner* — Mark Williams
(74) *Attorney, Agent, or Firm* — Michael Best & Friedrich LLP

(57) ABSTRACT

A lock assembly that includes a push button assembly manually movable from an unlocked position to a locked position, a biasing member that biases the push button assembly toward the unlocked position, and a retaining member that engages the push button assembly and a lock member to retain the push button assembly in the locked position. The lock assembly further includes an exterior handle, a driver, and a cam member coupled to the driver for rotation with the driver. The push button assembly engages the cam member to rotate the driver toward a locked position when the push button assembly moves from the unlocked position toward the locked position and the push button assembly engages the cam member to rotate the driver toward an unlocked position when the push button moves from the locked position toward the unlocked position.

32 Claims, 10 Drawing Sheets

U.S. PATENT DOCUMENTS

| | | | | |
|---|---|---|---|---|
| 6,553,799 | B2 | 4/2003 | Bates et al. | |
| 6,615,630 | B2 * | 9/2003 | Wu et al. | 70/472 |
| 6,623,053 | B1 * | 9/2003 | Hwang | 292/336.3 |
| 6,807,833 | B1 * | 10/2004 | Huang et al. | 70/107 |
| 6,860,529 | B2 | 3/2005 | Chong et al. | |
| 6,929,290 | B2 * | 8/2005 | Don | 292/169 |
| 2003/0056556 | A1 | 3/2003 | Park et al. | |
| 2003/0107223 | A1 | 6/2003 | Chong et al. | |
| 2004/0144143 | A1 | 7/2004 | Don | |

OTHER PUBLICATIONS

International Search Report and Written Opinion for corresponding International Application No. PCT/US2008/075112 mailed on Feb. 11, 2009.

* cited by examiner

DOOR LOCK ASSEMBLY

BACKGROUND

The present invention relates to locks, and more particularly to tubular locks for doors.

Door locks typically include an interior assembly, an exterior assembly, and a latch assembly. When the door is closed the latch assembly engages a pocket or recess formed in a frame of the door to hold the door in the closed position. Generally, in tubular lock assemblies the interior and exterior assemblies both include a handle that is rotatable to retract the latch so that the door can be opened. Often, the interior assembly further includes a locking member having a push button or a turn button that is manually operable to lock the lock assembly. When the lock assembly is locked, the exterior handle is inoperable to retract the latch and the door cannot be opened using the exterior handle.

SUMMARY

In one embodiment, the invention provides a lock assembly for use with a latch movable from an extended position to a retracted position. The lock assembly includes an interior assembly having an interior handle, a push button assembly manually movable from an unlocked position to a locked position, and a biasing member that biases the push button assembly toward the unlocked position. The interior assembly further includes a retaining member that engages the push button assembly and a lock member to retain the push button assembly in the locked position. The lock assembly further includes an exterior assembly including an exterior handle, a driver rotatable from a locked position to an unlocked position such that the exterior handle is manually operable to retract the latch when the driver is in the unlocked position and inoperable to retract the latch when the driver is in the locked position. The lock assembly further includes a cam member coupled to the driver for rotation with the driver. The push button assembly engages the cam member to rotate the driver toward the locked position when the push button assembly moves from the unlocked position toward the locked position and the push button assembly engages the cam member to rotate the driver toward the unlocked position when the push button moves from the locked position toward the unlocked position.

In yet another embodiment, the invention provides a lock assembly for use with a latch movable from an extended position to a retracted position. The lock assembly includes a driver rotatable from a locked position to an unlocked position and an interior assembly including a push button assembly manually movable from an unlocked position to a locked position and operable to rotate the driver from the unlocked position to the locked position. The interior assembly further includes a biasing member that biases the push button assembly toward the unlocked position and a retaining member that engages the push button assembly and a member to retain the push button assembly in the locked position. The lock assembly further includes an exterior assembly including an exterior handle manually operable to retract the latch when the driver is in the unlocked position and inoperable to retract the latch when the driver is in the locked position. The exterior assembly further includes a lock cylinder configured to receive a key and coupled to the driver. The lock cylinder and the key are operable to rotate the driver from the locked position toward the unlocked position. Rotation of the driver from the locked position to the unlocked position disengages the retaining member such that the biasing member moves the push button from the locked position to the unlocked position.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
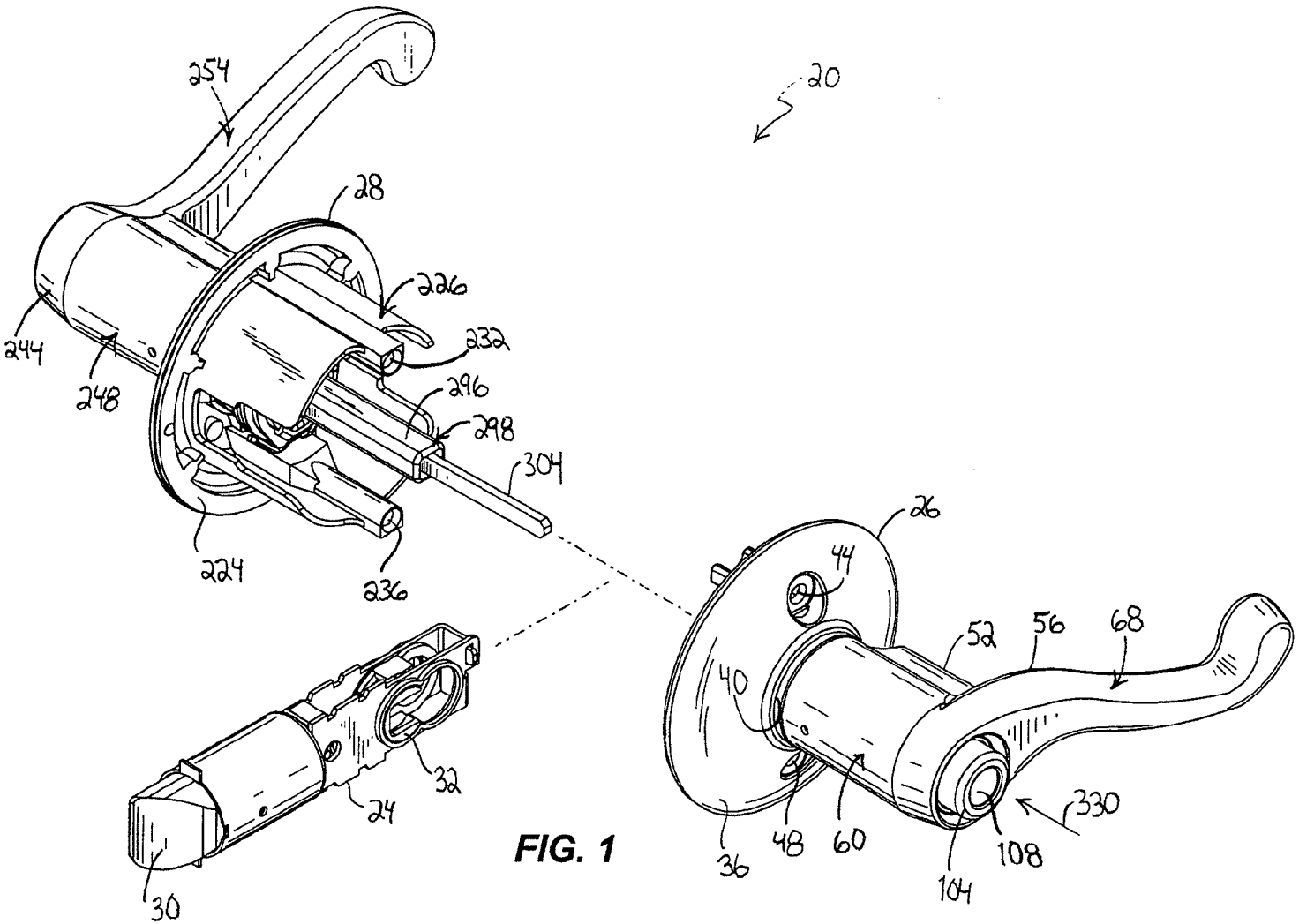
FIG. 1 is a partially exploded view of a lock assembly embodying the present invention.

FIG. 1 illustrates a lock assembly 20. The illustrated lock assembly 20 is a tubular lock assembly for use with a door (not illustrated). The lock assembly 20 includes a latch assembly 24, an interior assembly 26, and an exterior assembly 28. The exterior assembly 28 is coupled to and extends from an exterior surface of the door and the interior assembly 26 is coupled to and extends from an interior surface of the door. The latch assembly 24 includes a latch 30 movable from an extended position to a retracted position using the interior and exterior assemblies 26 and 28. A latch actuator 32 of the latch assembly 24 is rotatable to retract the latch 30. As would be understood by one of skill in the art, the latch assembly 24 is located between the exterior assembly 28 and the interior assembly 26 in a bore of the door such that the latch 30 engages a pocket, often defined by a strike plate, in a frame of the door to hold the door in the closed position.

Figure 2:
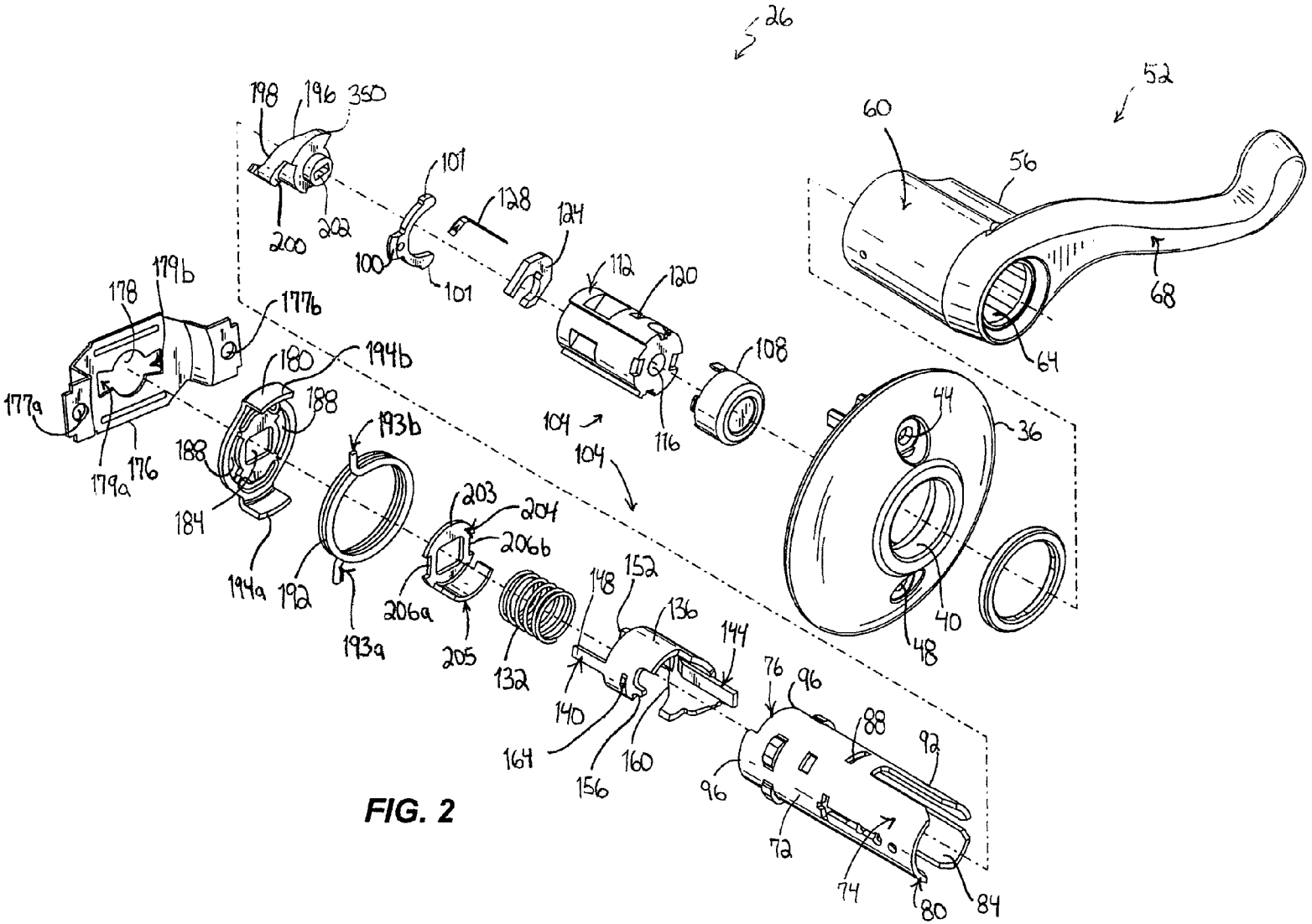
FIG. 2 is an exploded view of an interior assembly of the lock assembly of FIG. 1.

Referring to FIG. 2, the interior assembly 26 includes an interior chassis 36. The interior chassis 36 couples to the door such that the interior chassis 36 is generally fixed with respect to the door. The interior chassis 36 includes a handle receiving aperture 40 that extends through the interior chassis 36. First and second fastener receiving apertures 44 and 48 also extend through the interior chassis 36. A fastener (not shown) extends through each of the fastener receiving apertures 44 and 48 to couple the interior chassis 36 to the door and to the exterior assembly 28 (FIG. 1).

With continued reference to FIGS. 1 and 2, a interior handle assembly 52 is coupled to the interior chassis 36 for rotation with respect to the interior chassis 36. The interior handle assembly 52 includes an interior handle 56 having a locking member receiving portion 60. The locking member receiving portion 60 defines a locking member receiving aperture 64. The interior handle 56 further includes an actuator portion 68. The actuator portion 68 is configured to be grasped by a user of the lock assembly 20 to rotate the interior handle 56 to retract the latch 30. The illustrated interior handle 56 is just one possible construction of the interior handle, and in other constructions the interior handle can take other suitable forms, such as round knobs and the like.

Referring to FIG. 2, a hollow interior spindle 72 is partially received within the locking member receiving aperture 64 of the interior handle 56. The interior spindle 72 includes a generally cylindrical outer wall portion 74 that defines an interior end portion 76, an exterior end portion 80, and an aperture 84 that extends longitudinally generally through the center of the outer wall portion 74 from the interior end portion 76 to the exterior end portion 80. The outer wall portion 74 further includes clip receiving apertures 88 and a retaining member receiving aperture 92. While only one clip receiving aperture 88 is visible in FIG. 2, the outer wall portion 74 includes a second clip receiving aperture that is opposite the illustrated clip receiving aperture 88. The outer wall portion 74 further includes retraction member engaging projections 96 that extend from the interior end portion 76.

A C-shaped clip 100 is located within the longitudinal aperture 84 of the interior spindle 72. When the interior assembly 26 is assembled, projections 101 on the clip 100 extend through the clip receiving apertures 88 of the interior spindle 72 to engage the interior handle 56, thereby coupling the interior spindle 72 to the interior handle 56 for co-rotation.

The interior assembly 26 further includes a push button assembly 104 that is manually movable from an outward unlocked position to an inward locked position. The push button assembly 104 includes a push button 108 that extends from the interior handle 56 when the interior assembly 26 is assembled (see FIG. 1) and the push button 108 is partially disposed within the locking member receiving aperture 64 of the interior handle 56.

With continued reference to FIG. 2, the push button assembly 104 further includes a body portion 112 coupled to and substantially fixed with respect to the push button 108. The body portion 112 is received within the longitudinal aperture 84 of the interior spindle 72 such that the body portion 112 is movable with respect to the interior spindle 72. The body portion 112 defines a hollow cavity 116 and a retaining member slot 120 connected to the cavity 116.

Figure 13:
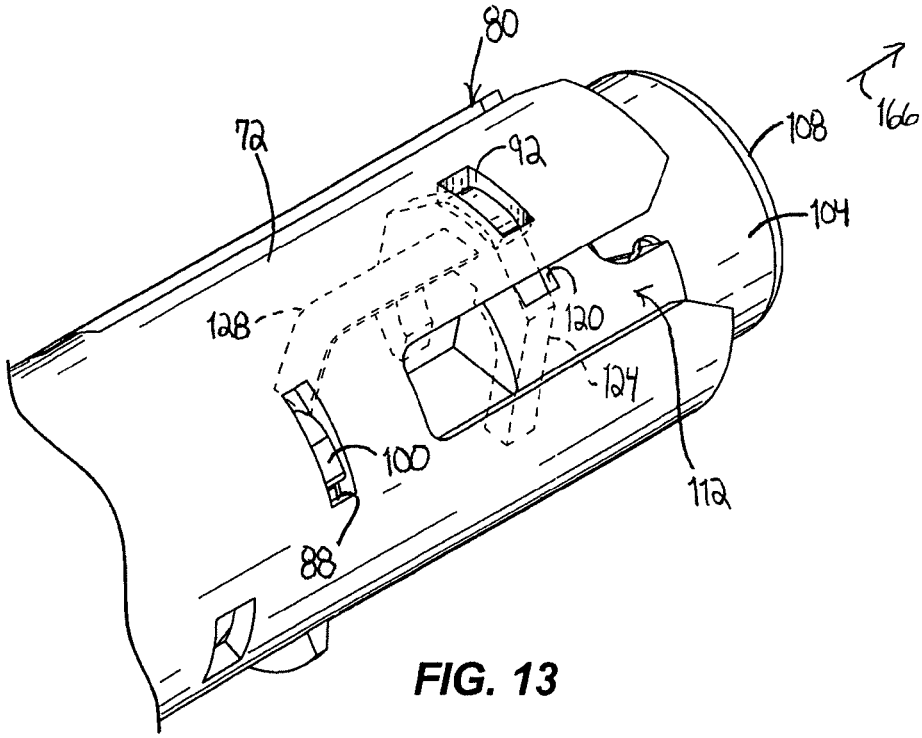
FIG. 13 is a perspective view of a portion of the interior assembly of FIG. 2 in the locked position.
Figure 14:
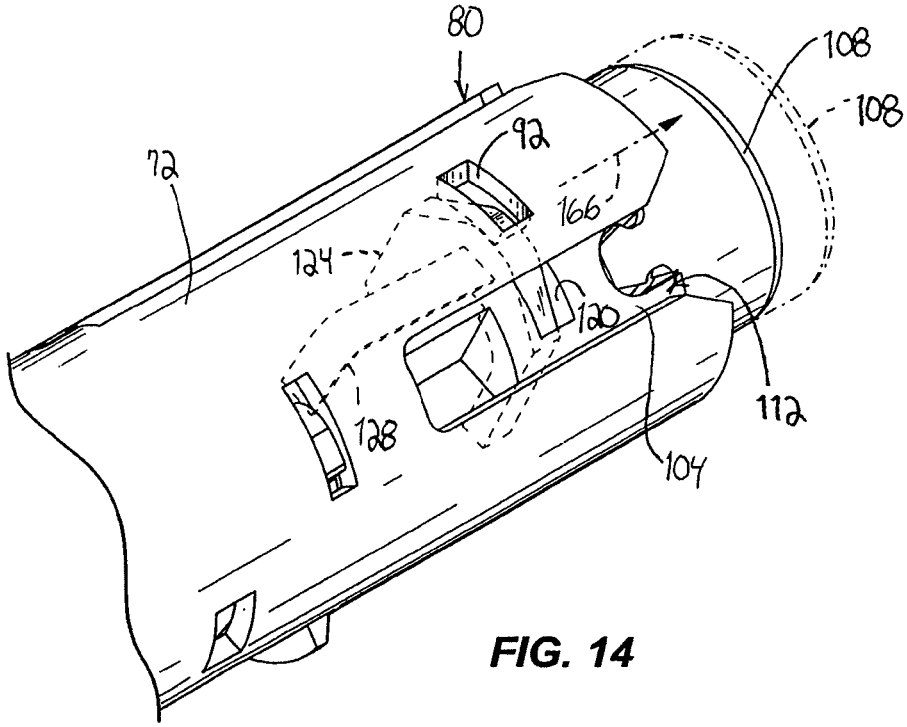
FIG. 14 is a perspective view of a portion of the interior assembly of FIG. 2 between the unlocked and locked positions.

A retaining member 124 is disposed within the cavity 116 and extends through the retaining member slot 120 of the body portion 112. As illustrated in FIGS. 13 and 14, and as will be discussed in more detail below, a portion of the retaining member 124 is selectively extendable through the retaining member receiving aperture 92 of the interior spindle 72 to retain the push button assembly 104 in the locked position (FIG. 13). A retaining member biasing member 128, which is a leaf spring in the illustrated construction, biases the retaining member 124 outward through the retaining member slot 120 to releasably retain the push button assembly 104 in the locked position.

Referring to FIG. 2, the push button assembly 104 further includes a coil spring 132. The coil spring 132 biases the push button assembly 104 toward the unlocked position, which is discussed in more detail below.

Figure 6:
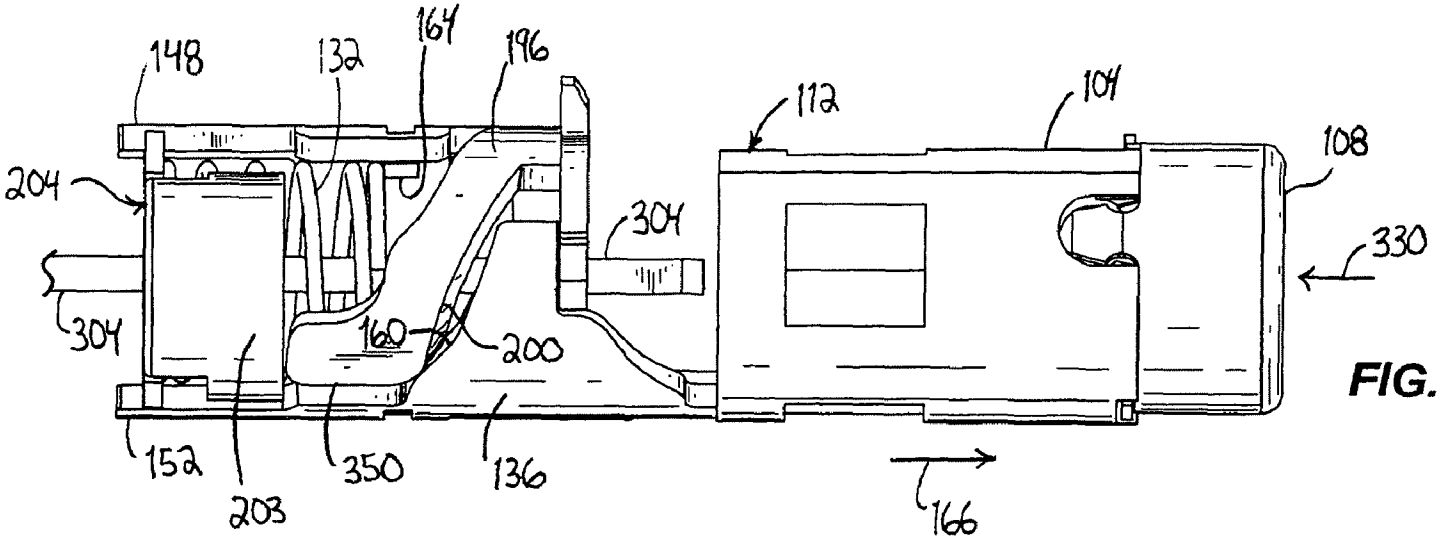
FIG. 6 is a top view of a portion of the interior assembly of FIG. 2 in an unlocked position.

A cam follower assembly 136 is coupled to and substantially fixed with respect to the body portion 112 of the push button assembly 104 such that the cam follower assembly 136 is coupled for rotation with the body portion 112. The cam follower assembly 136 includes an interior end portion 140 and an exterior end portion 144. The interior end portion 140 is defined by first and second axial projections 148, 152. The cam follower assembly 136 further includes a cam follower 156 and a cam surface 160. As best seen in FIG. 6, the cam follower assembly 136 partially surrounds the coil spring 132 of the push button assembly 104 and the cam follower assembly 136 includes a tab 164. The coil spring 132 biases the tab 164 and the push button 108 toward the unlocked position (in the direction of arrow 166 of FIG. 6).

The interior assembly 26 further includes a base plate 176 that is generally fixed with respect to the interior chassis 36, such as by fasteners (not shown) that extend through apertures 177*a* and 177*b*. The base plate 176 includes an aperture 178 having side portions 179*a* and 179*b* each having an inner dimension that is sized slightly larger than the projections 148, 152 of the cam follower assembly 136. When the interior assembly 26 is assembled the projections 148 and 152 extend through the side portions 179*a* and 179*b*, respectively, and therefore provide a limited amount of rotation of the push button assembly 104 with respect to the interior chassis 36.

Referring to FIG. 2, the interior assembly 26 further includes a latch retractor 180. The latch retractor 180 includes a centrally located square aperture 184 and arcuate apertures 188 that partially surround the square aperture 184. The arcuate apertures 188 each receive a respective retraction member engaging projection 96 of the interior spindle 72 to couple the latch retractor 180 and the interior spindle 72 for co-rotation. As would be understood by one of skill in the art, a torsion spring 192 is coupled to the latch retractor 180 using end portions 193*a* and 193*b* of the spring 192 that contact tabs 194*a* and 194*b* of the latch retractor 180, respectively, to rotationally bias the latch retractor 180 and the interior handle 56 relative to the interior chassis 36.

Figure 11:
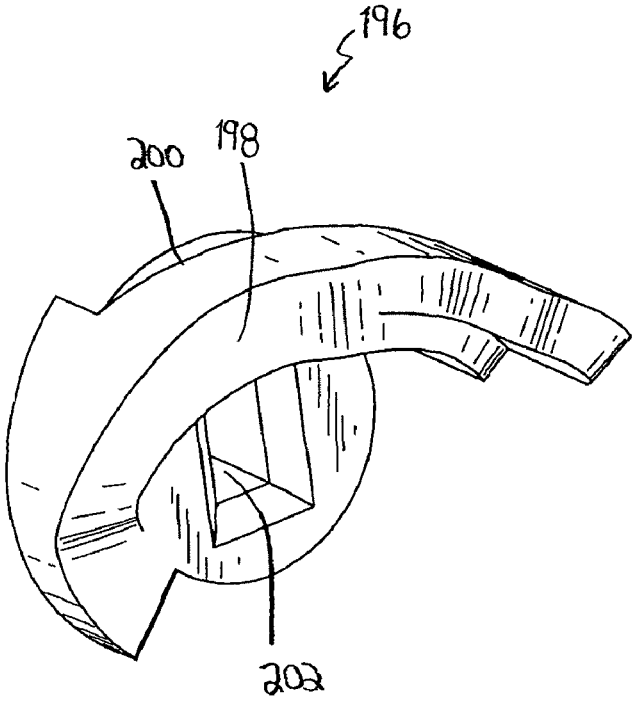
FIG. 11 is a perspective view of a cam member of the interior assembly of FIG. 2.
Figure 12:
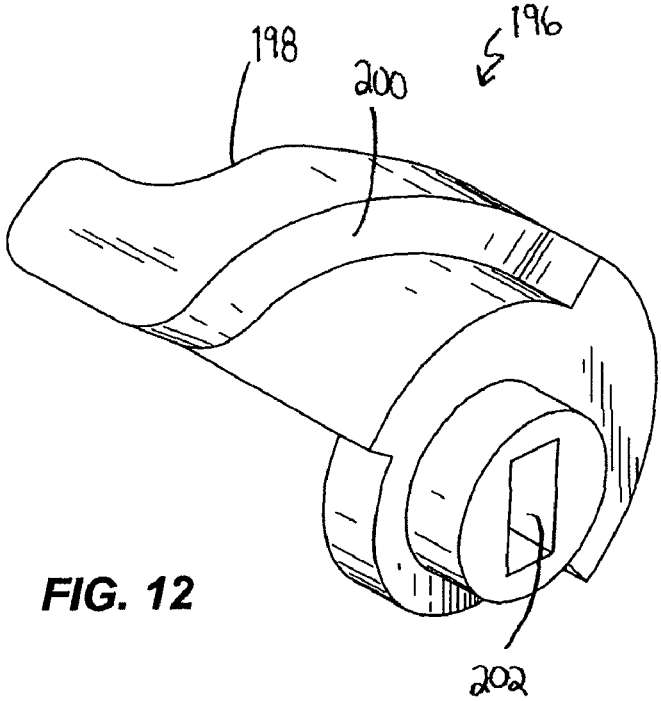
FIG. 12 is an alternative perspective view of the cam member of FIG. 11.

As best seen in FIGS. 2, 11, and 12, the interior assembly 26 includes a cam member 196, the purpose of which will be discussed in more detail below. The cam member 196 includes an interior cam surface 198, an exterior cam surface 200, and a rectangular aperture 202 extending longitudinally through the cam member 196.

Figure 9:
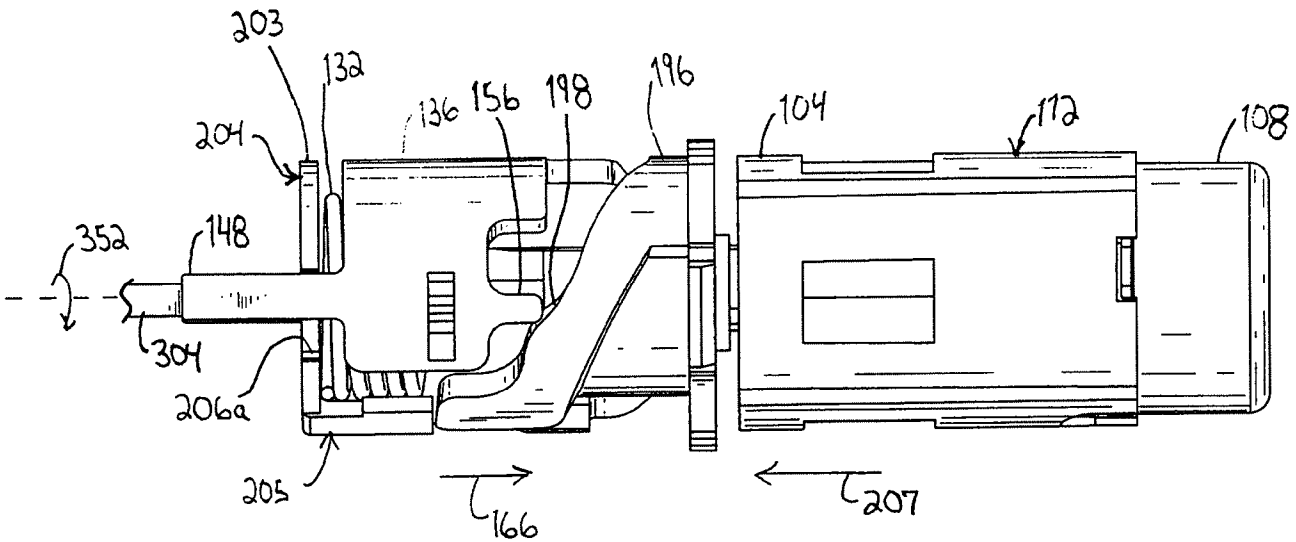
FIG. 9 is a side view of a portion of the interior assembly of FIG. 2 in the locked position.

Referring to FIG. 2, the interior assembly 26 further includes a base member 203 having a planar portion 204 and a cam support portion 205. The base member 203 further includes a first recess 206*a* and a second recess 206*b* formed in the planar portion 204. When the interior assembly 26 is assembled, the cam assembly spring 132 contacts the planar portion 204 of the base member 203 to hold the base member 203 against the latch retractor 180. Meanwhile, the latch retractor 180 abuts the base plate 176, which is held fixed, and therefore the base member 203 and the latch retractor 180 are substantially prevented from moving in the axial direction. As best seen in FIG. 9, the cam support portion 205 of the base member 203 contacts the cam member 196 to prevent axial movement of the cam member 196 in the direction of arrow 207. Also, the first recess 206*a* receives the first projection 148 of the cam follower assembly 136 and the second recess 206*b* receives the second projection 152 of the cam follower assembly 136 (only recess 206*a* and projection 148 visible in FIG. 9), thereby allowing the limited amount of rotation of the cam follower assembly 136 that is defined by the enlarged end portions 179*a* and 179*b* of the aperture 178 formed in the base plate 176 (see FIG. 2), the purpose of which will be discussed in more detail below.

Figure 3A:
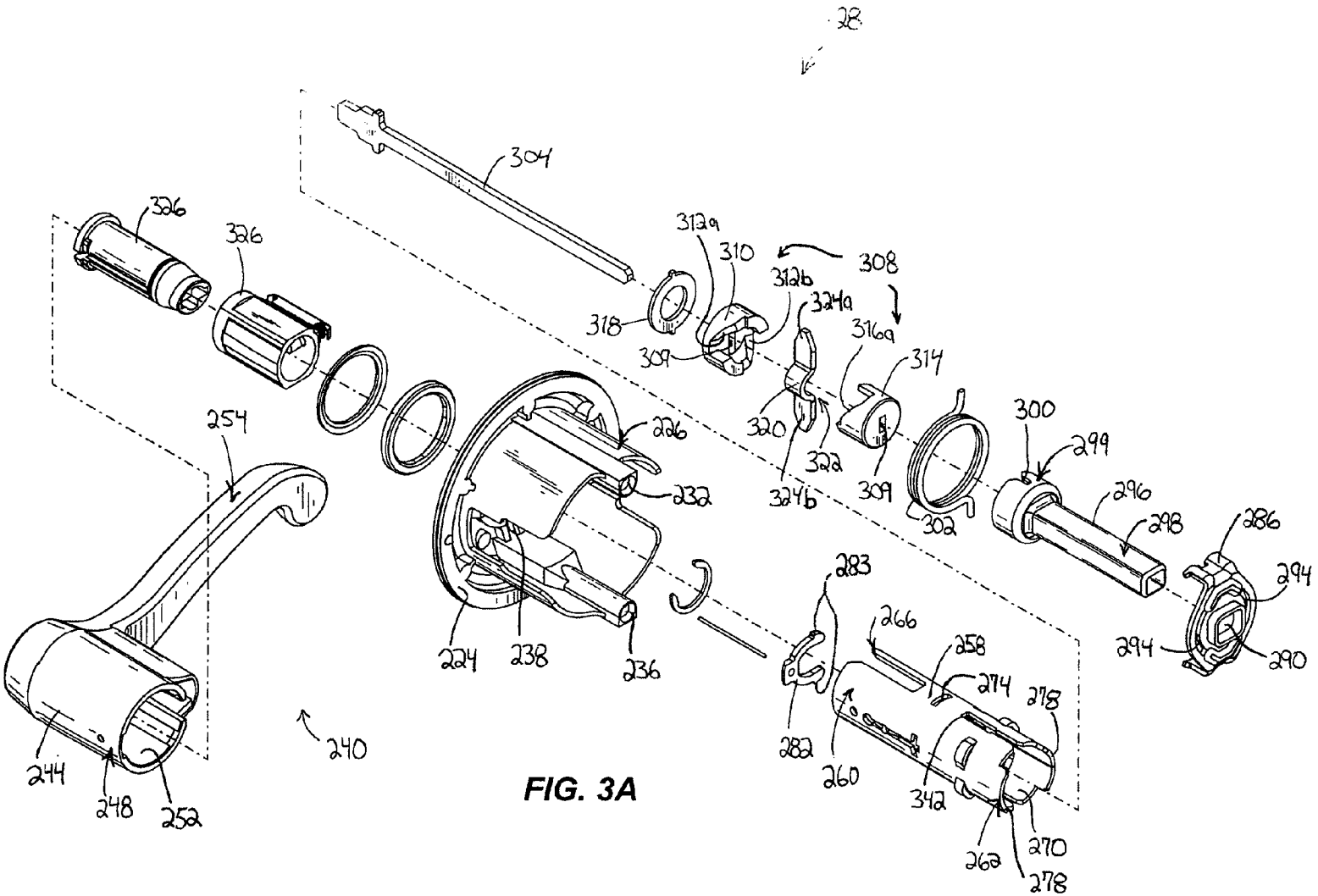
FIG. 3A is an exploded view of an exterior assembly of the lock assembly of FIG. 1.
Figure 3B:
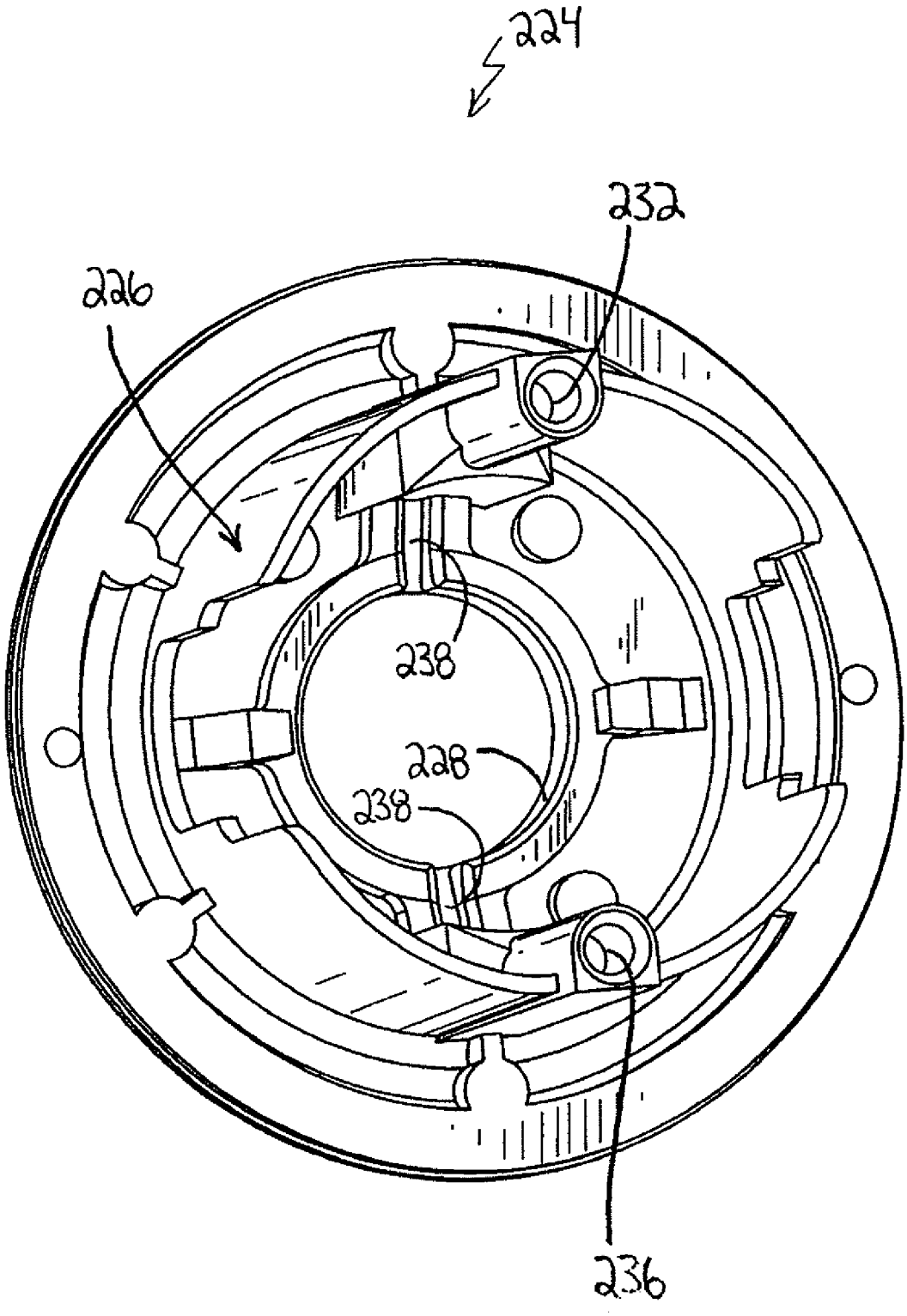
FIG. 3B is a perspective view of a chassis of the exterior assembly of FIG. 3B.

Referring to FIGS. 3A and 3B, the exterior assembly 28 includes an exterior chassis 224. The exterior chassis 224 includes a generally cylindrical portion 226 that is received in a bore of the door such that the exterior chassis 224 is coupled to the door and generally fixed with respect to the door. The exterior chassis 224 further includes a handle receiving aperture 228 that extends through the exterior chassis 224 and first and second fastener receiving apertures 232, 236. The apertures 232, 236 receive first and second fasteners, respectively, that extend through the apertures 44, 48 of the interior chassis 36 (FIG. 1) to couple the interior and exterior assemblies 26, 28 to the door. As best seen in FIG. 3B, the exterior chassis 224 further includes diametrically opposed locking member receiving slots 238 that are located within the cylindrical portion 226 of the exterior chassis 224.

With continued reference to FIGS. 3A and 3B, an exterior handle assembly 240 is coupled to the exterior chassis 224 for rotation with respect to the exterior chassis 224. The exterior handle assembly 240 includes an exterior handle 244 having a locking member receiving portion 248. The locking member receiving portion 248 defines a locking member receiving aperture 252, and the locking member receiving portion 248 is partially located within the handle receiving aperture 228 (FIG. 3B) of the exterior chassis 224 when the exterior assembly 28 is assembled. The exterior handle 244 further includes an actuator portion 254 configured to be grasped by a user of the lock assembly 20 to rotate the exterior handle 244 to retract the latch 30 when the push button assembly 104 is in the unlocked position (FIG. 1), discussed in more detail below. The illustrated exterior handle 244 is just one possible construction of the exterior handle, and in other constructions the exterior handle 244 can take other suitable forms, such as round knobs and the like.

A hollow exterior spindle 258 is partially received within the locking member receiving aperture 252 of the exterior handle 244. The exterior spindle 258 includes an outer wall portion 260 that defines an interior end portion 262, an exterior end portion 266, and an aperture 270 that extends longitudinally generally through the center of the outer wall portion 260 from the interior end portion 262 to the exterior end portion 266. The outer wall portion 260 further includes clip receiving apertures 274. While only one clip receiving aperture 274 is visible in FIG. 3A, the outer wall portion 260 includes a second clip receiving aperture opposite the illustrated clip receiving aperture 274. The outer wall portion 260 further includes arcuate retraction member engaging projections 278 that extend axially from the interior end portion 262.

A C-shaped clip 282 is located within the longitudinal aperture 270 of the exterior spindle 258. Projections 283 on the clip 282 extend through the clip receiving apertures 274 of the exterior spindle 258 to engage the exterior handle 244 such that the exterior spindle 258 and the exterior handle 244 are coupled for co-rotation with respect to the exterior chassis 224.

With continued reference to FIG. 3A, the exterior assembly 28 further includes an exterior latch retractor 286 having a generally centrally located square aperture 290 and arcuate apertures 294 that partially surround the centrally located square aperture 290. Each of the arcuate apertures 294 receives a respective retraction member engaging projection 278 of the exterior spindle 258 to couple the exterior latch retractor 286 and the exterior spindle 258 for co-rotation with respect to the exterior chassis 224.

An actuator tube 296 having a portion 298 with a generally square cross section extends through the square aperture 290 of the exterior latch retractor 286 such that rotation of the exterior latch retractor 286 rotates the actuator tube 296. Referring to FIGS. 2 and 3A, the square portion 298 of the actuator tube 296 also extends through the square aperture 184 of the interior latch retractor 180 such that rotation of the interior latch retractor 180 rotates the actuator tube 296. The actuator tube 296 further includes a generally cylindrical enlarged end portion 299 and an axial slot 300 formed in the enlarged end portion 299. While only a portion of the axial slot 300 is visible in FIG. 3A, another portion of the slot 300 is formed in the enlarged end portion 299 diametrically opposed to the visible portion of the slot 300 in FIG. 3A.

Referring to FIG. 3A, as would be understood by one of skill in the art, a torsion spring 302 is coupled to the exterior latch retractor 286. The torsion spring 302 rotationally biases the latch retractor 286 with respect to the chassis 224. Therefore, the exterior spindle 258 is also biased by the spring 302 such that the exterior handle 244 is biased with respect to the exterior chassis 224 to a return or rest position illustrated in FIG. 1.

Referring to FIGS. 2 and 3A, the exterior assembly 28 further includes a driver 304. The driver 304 is rotatable with respect to the exterior chassis 224 and the actuator tube 296. The driver 304 extends through the rectangular aperture 202 of the cam member 196 and the drive 304 has outer dimensions that complement the inner dimensions of the aperture 202 such that the cam member 196 and the driver 304 are coupled for co-rotation when the lock assembly 20 is assembled.

Figure 4:
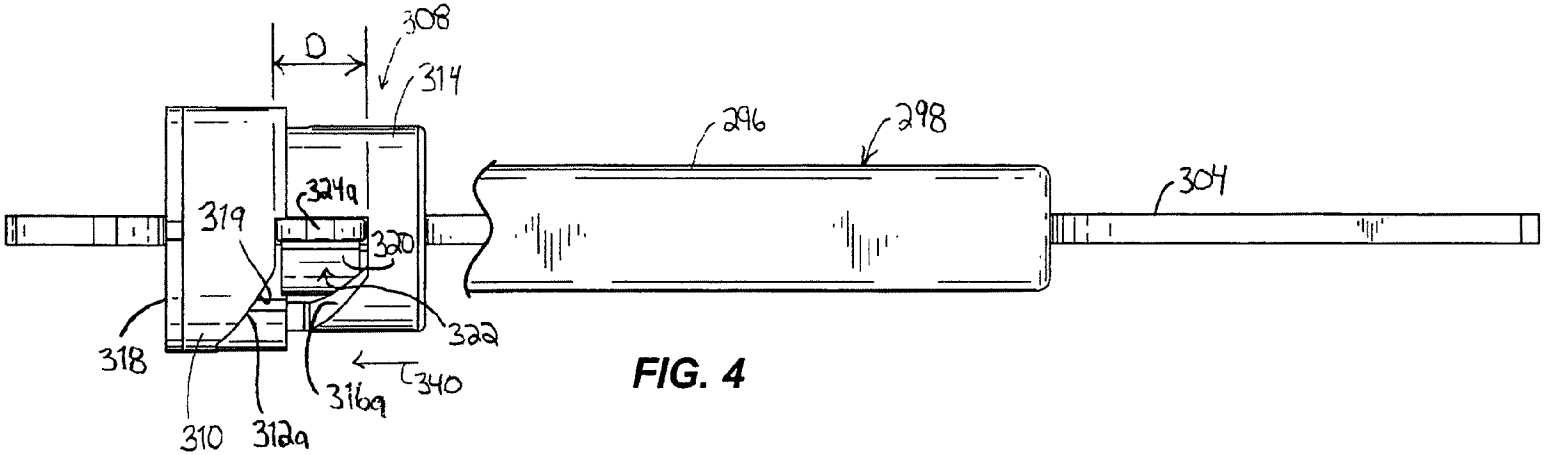
FIG. 4 is a top view of a portion of the exterior assembly of FIG. 3A in an unlocked position.
Figure 5:
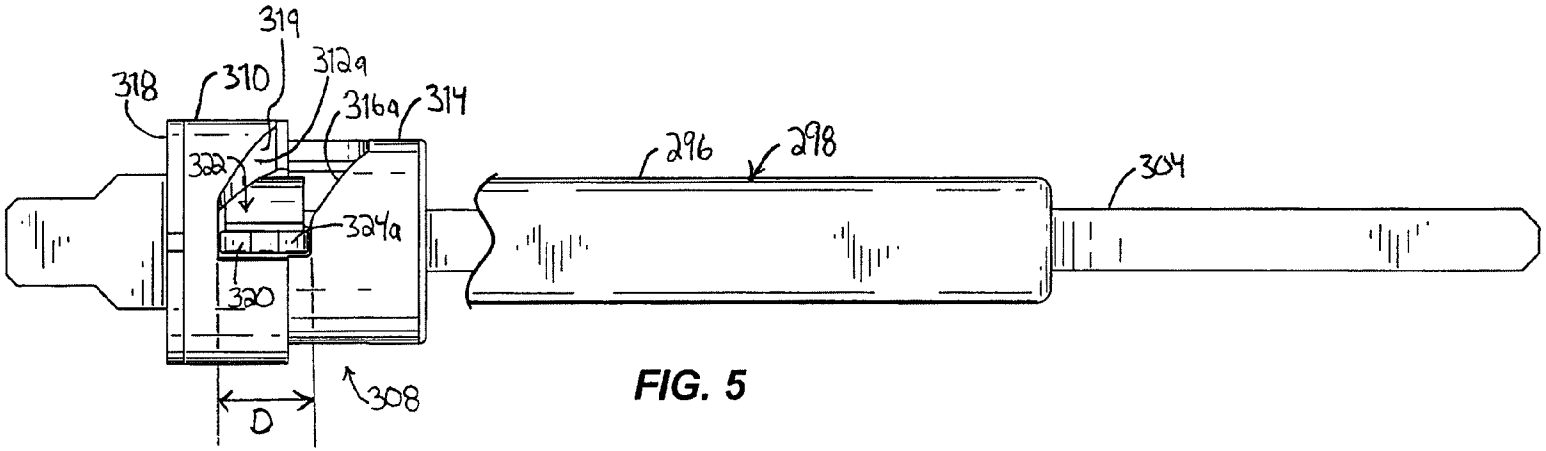
FIG. 5 is a top view of a portion of the exterior assembly of FIG. 3A in a locked position.

Referring to FIGS. 3A, 4, and 5, a cam assembly 308 is coupled to the driver 304 for rotation with the driver 304. The illustrated cam assembly 308 includes an exterior cam member 310 and an interior cam member 314. Each of the cam members 310 and 314 has therein a rectangular slot 309 through which the driver 304 extends so that the cam members 310 and 314 rotate together with the driver 304. The cam member 310 defines cam surfaces 312*a* and 312*b* and the cam member 314 defines cam surfaces 316*a* and 316*b* (316*b* not visible in FIG. 3A). The exterior cam member 310 abuts a plate 318 and the interior cam member 314 is received in the enlarged end portion 299 of the actuator tube 296 such that the cam members 310 and 314 are held in abutment and generally do not move along the driver 304 when the exterior assembly 28 is assembled. The cam surfaces 312*a* and 316*a* oppose each other and define therebetween a helical slot 319, and the cam surfaces 312*b* and 316*b* oppose each other and define therebetween a helical slot 319 (only one helical slot 319 is visible in FIGS. 4 and 5). Each of the helical slots 319 has a width D equal to the distance between the opposing cam surfaces 312*a* and 316*a* or 312*b* and 316*b*. While the illustrated cam assembly 308 includes the exterior cam member 310 and the interior cam member 314, in other constructions the cam assembly can be formed using a single member.

An exterior handle locking member 320 is captured between the cam members 310 and 314. The locking member 320 includes a central half cylinder portion 322 and opposed projections or ears 324*a* and 324*b* extending from the central portion 322. When the exterior assembly 28 is assembled (as best seen in FIG. 4), the half cylinder portion 322 of the exterior handle locking member 320 partially surrounds the driver 304 and the ears 324*a* and 324*b* extend through the helical slots 319. As described below, the ears can move in the slots in response to movement of the cam members 310 and 314.

With continued reference to FIG. 3A, the exterior assembly 28 further includes a lock cylinder 326 retained within the locking member receiving aperture 252 of the exterior handle 244. The lock cylinder 326 is coupled to the driver 304 and is configured to receive a key. As would be understood by one of skill in the art, the lock cylinder 326 and the key are operable to rotate the driver 304.

In operation, referring to FIGS. 1 and 6, when the push button assembly 104 is in the outward unlocked position, as illustrated in FIGS. 1 and 6, a user can manually rotate either the interior handle 68 or the exterior handle 254 to retract the latch 30 in order to open the door. Referring to FIGS. 1 and 3A, rotation of the exterior handle 254 rotates the exterior spindle 258, which rotates the exterior latch retractor 286, thereby rotating the actuator tube 296. Rotation of the actuator tube 296, which is engaged with the latch actuator 32, retracts the latch 30. When the latch 30 is retracted, the user is able to open the door. Referring to FIG. 2, similarly, rotation of the interior handle 68 rotates the interior spindle 72, which rotates the interior latch retractor 180, thereby rotating the actuator tube 296 (FIG. 3A) to retract the latch 30.

Figure 7:
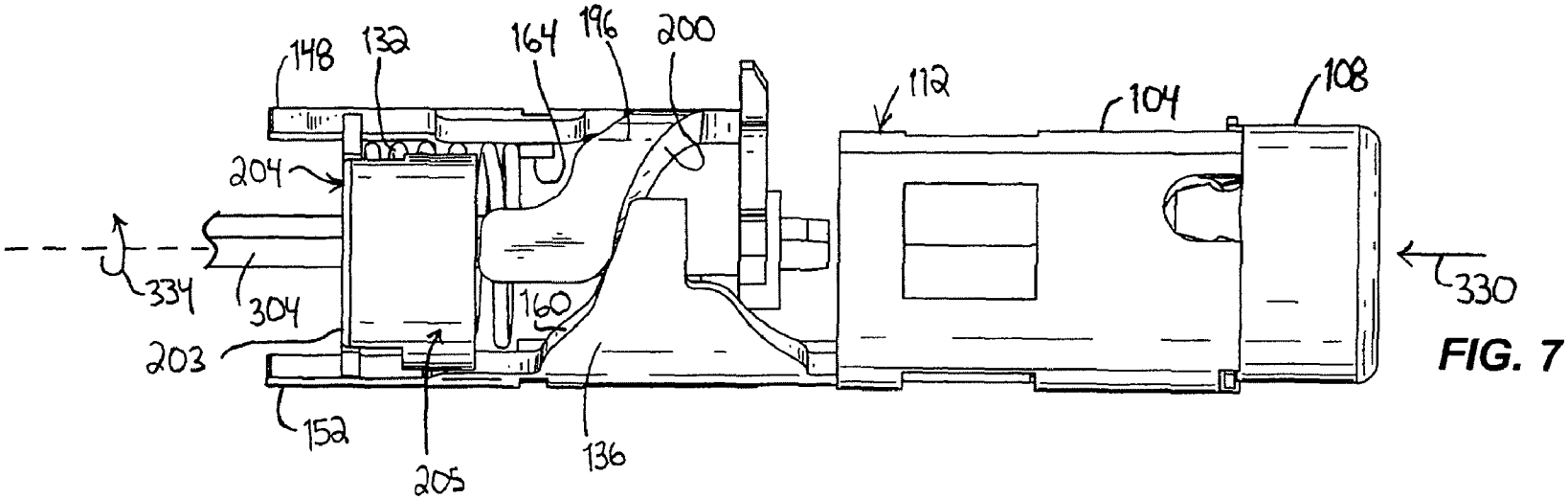
FIG. 7 is a top view of a portion of the interior assembly of FIG. 2 between the unlocked position of FIG. 6 and a locked position.
Figure 8:
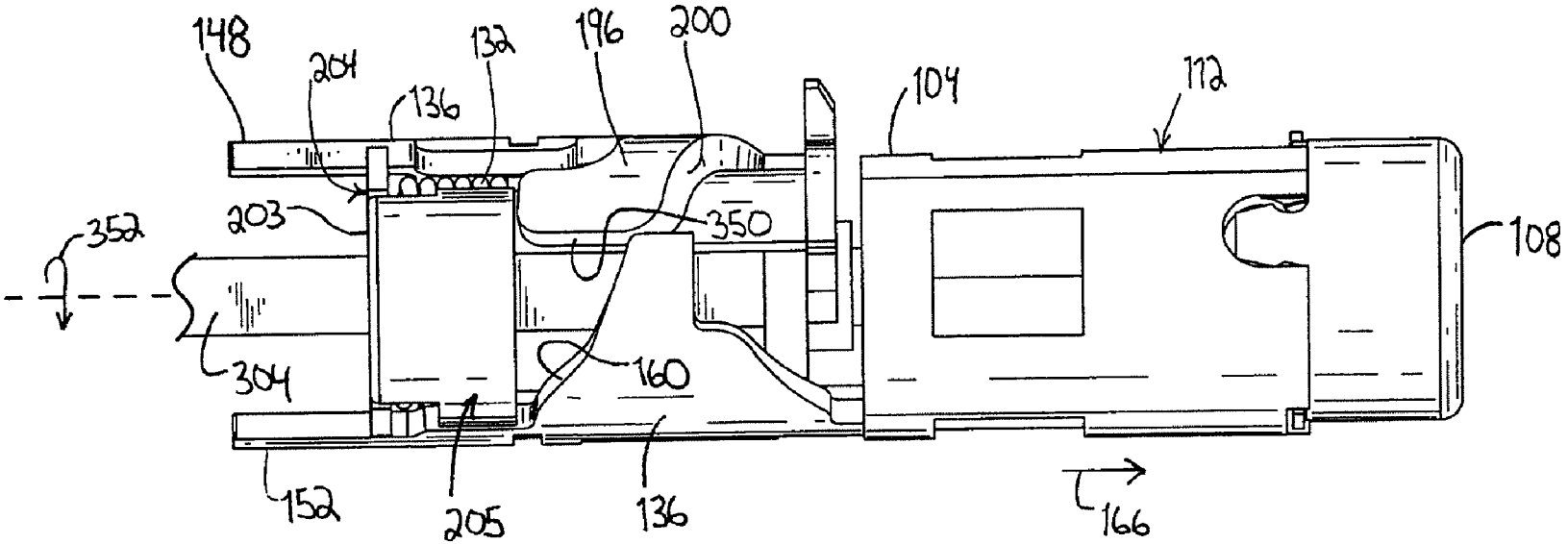
FIG. 8 is a top view of a portion of the interior assembly of FIG. 2 in the locked position.

The user can lock the lock assembly 20 from the interior assembly 26 by using the push button assembly 104. When the lock assembly 20 is locked, the exterior handle 254 is inoperable to retract the latch 30. FIG. 6 illustrates the push button assembly 104 in the outward unlocked position. To lock the lock assembly 20, the push button assembly 104 is moved by manually depressing the push button 108 in the direction of arrow 330 (see FIGS. 1 and 6). When the push button assembly 104 is pushed in the direction of the arrow 330, against the bias of the spring 132, the cam surface 160 of the cam follower assembly 136 cams against the exterior cam surface 200 of the cam member 196. Because the projections 148 and 152 extend through the apertures 179*a* and 179*b* of the base plate 176 (FIG. 2), the cam follower assembly 136 and the remainder of the push button assembly 104 is substantially fixed against rotation with respect to the interior chassis 36. However, because the apertures 179*a* and 179*b* have inner dimensions that are slightly larger than outer dimensions of the projections 148 and 152, the push button assembly 104 can rotate slightly, the purpose of which will be discussed in more detail below. Therefore, when the push button assembly 104 moves in the direction of arrow the 330, the cam follower assembly 136 forces the cam member 196, which is prevented from moving in the axial direction by the base member 203, to rotate in the direction of arrow 334 of FIG. 7, which is clockwise as viewed from an end of the interior assembly defined by the push button 108. The cam member 196 is coupled for rotation with the driver 304, and therefore rotation of the cam member 196 causes a corresponding rotation of the driver 304. As the user continues to push the push button assembly 104 in the direction of arrow 330, the driver 304 continues to rotate in the direction of the arrow 334 (clockwise as viewed from the end of the interior assembly defined by the push button 108) until the push button assembly 104 and the driver 304 reach the locked position as illustrated in FIG. 8.

Referring to FIG. 13, when the push button assembly 104 reaches the locked position, the retaining member 124 is aligned with the retaining member aperture 92 of the interior spindle 72 (the push button assembly 104 moves with respect to the spindle 72 when moving between the locked and unlocked positions) and the spring 128 forces the retaining member 124 to extend into the retaining member aperture 92. In the position illustrated in FIG. 13, the retaining member 124 retains the push button assembly 104 in the inward locked position against the bias in the direction of the arrow 166 caused by the spring 132 (FIG. 8).

Referring to FIGS. 4 and 6, when the push button assembly 104 is in the unlocked position, the driver 304 is in an unlocked position as illustrated in FIG. 4. As discussed above, when the push button assembly 104 is moved to the locked position, the driver 304 is rotated to a locked position (FIG. 5). When the driver 304 rotates from the unlocked position (FIG. 4) to the locked position (FIG. 5) the interior and exterior cam members 314 and 310 also rotate with the driver 304. Rotation of the cam members 310 and 314 causes the helical slots 319 to rotate, and this causes the exterior handle locking member 320 to move along the driver 304 in the direction of arrow 340 from an unlocked position (FIG. 4) to a locked position (FIG. 5).

Referring to FIGS. 3A, 3B, and 5, in the locked position, the exterior handle locking member 320 extends through an elongated slot 342 of the exterior spindle 258 and the exterior handle locking member 320 is received within the slots 238 of the exterior chassis 224. While only a portion of the elongated slot 342 is visible in FIG. 3A, the exterior spindle 258 includes another portion of the elongated slot 342 diametrically opposed to the visible portion. Therefore, when the locking member 320 is in the locked position, the exterior spindle 258 is coupled to the exterior chassis 224 such that the exterior spindle 258 generally cannot rotate with respect to the exterior chassis 224. The exterior handle 254 is coupled for rotation with the exterior spindle 258, and therefore when the exterior handle locking member 320 is in the locked position the exterior handle 254 generally cannot be rotated with respect to the chassis 224 and the exterior handle 254 is inoperable to retract the latch 30 (FIG. 1).

Referring to FIG. 3A, as would be understood by one of skill in the art, the driver 304 can also be rotated between the locked and unlocked positions using a key that is received within the lock cylinder 326. The key can be rotated to rotate the driver 304 and further rotation of the key in the unlocked direction can retract the latch 30. Rotation of the driver 304 from the locked position (FIG. 5) toward the unlocked position (FIG. 4) also rotates the cam member 196 (FIG. 8) that is coupled for rotation with the driver 304. When the cam member 196 rotates from the locked position (FIG. 8) toward the unlocked position (FIG. 6) a cam assembly engaging surface 350 of the cam member 196 contacts the cam assembly 136 and forces the cam assembly 136 and the remainder of the push button assembly 104 to rotate slightly in the direction of arrow 352, which is counterclockwise as viewed from the end of the interior assembly defined by the push button 108. However, rotation of the push button assembly 104 is limited because the projections 148, 152 are received within the apertures 179*a* and 179*b*, respectively, of the base plate 176 (see FIG. 2).

Referring to FIGS. 13 and 14, as the push button assembly 104 is rotated by the cam member 196, the retaining member 124, coupled for rotation with the push button assembly 104, cams against the interior spindle 72 and the retaining member 124 is forced to move out of the retaining member aperture 92 of the interior spindle 72 (see FIG. 14) and into the body portion 112 of the push button assembly 104. With the retaining member 124 no longer received within the retaining member slot 92 of the interior spindle 72, the biasing member 132 (FIG. 9) forces the push button assembly 104 to move back to the unlocked position (i.e., in the direction of the arrow 166).

Figure 10:
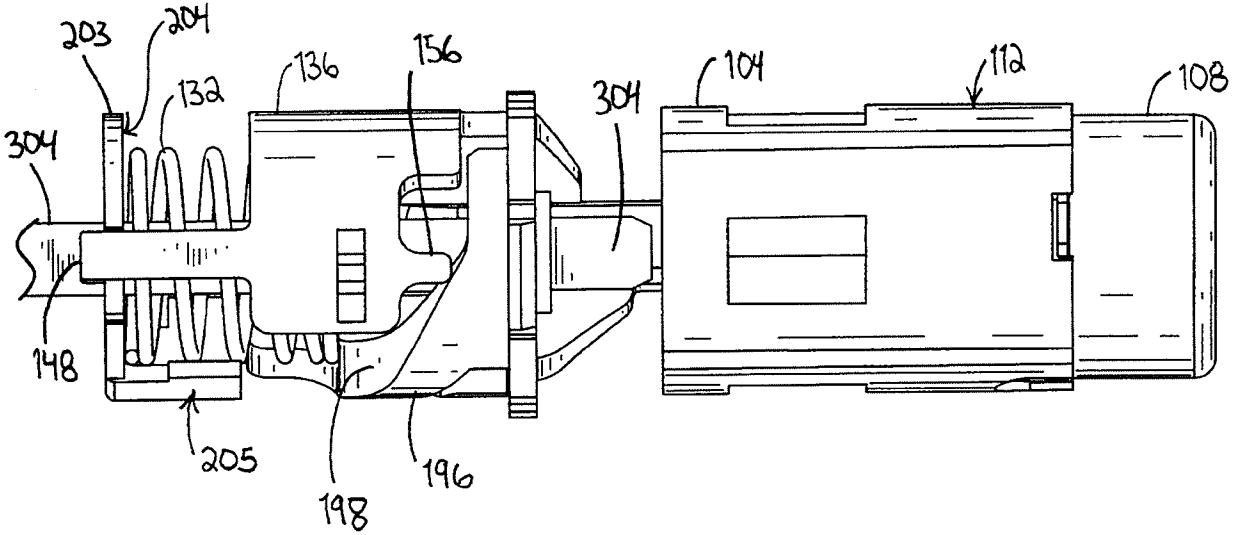
FIG. 10 is a side view of a portion of the interior assembly of FIG. 2 in the unlocked position.

Referring to FIG. 9, as the biasing member 132 forces the cam assembly 136 and the remainder of the push button assembly 104 toward the unlocked position (i.e., in the direction of the arrow 166), the cam follower 156 of the cam assembly 136 pushes against the interior cam surface 198 of the cam member 196. The force of the cam follower 156 acting on the interior cam surface 198 forces the cam member 196 to rotate in the direction of the arrow 352 of FIG. 9 (is counterclockwise as viewed from the end of the interior assembly defined by the push button 108), back toward the unlocked position (FIG. 10). Because the driver 304 is coupled for rotation with the cam member 196, the driver 304 is likewise rotated to the unlocked position and the exterior handle locking member 320 (FIG. 4) is moved to an unlocked position.

When the driver 304 is rotated from the locked position (FIG. 5) back to the unlocked position (FIG. 4) the cam members 310 and 314 rotate with the driver 304 and force the exterior handle locking member 320 to move along the driver 304 back to the unlocked position of FIG. 4. Rotation of the exterior handle locking member 320 is substantially prevented by the locking member receiving slots 238 of the chassis 224 and the slot 300 in the enlarged end portion 299 (FIG. 3A) of the actuator tube 296. When the exterior handle locking member 320 is in the unlocked position (FIG. 4), the exterior handle locking member 320 is no longer received within the slots 238 of the exterior chassis 224 (FIG. 3B) and the exterior spindle 258 and exterior handle 254 are rotatable to retract the latch 30 as discussed above.

Referring to FIGS. 1 and 2, the lock assembly 20 can also be unlocked by rotating the interior handle 56. When the push button assembly 104 is in the inward locked position (FIG. 8), rotation of the interior handle 56 rotates the interior spindle 72. Referring to FIG. 14, as the interior spindle 72 rotates, the interior spindle 72 cams against the retaining member 124 to force the retaining member 124 out of the retaining member engaging aperture 92 of the interior spindle 72 and into the body portion 112 of the push button assembly 108. As discussed above, with the retaining member 124 no longer interconnecting the push button assembly 104 and interior spindle 72 (see FIG. 14), the spring 132 (see FIG. 9) forces the push button assembly 104 to move toward the outward unlocked position as discussed above. Referring to FIG. 9, also as discussed above, as the spring 132 forces the push button assembly 104 toward the unlocked position, the cam follower 156 contacts the cam member 196 to rotate the cam member 196 and the driver 304 toward the unlocked positions. Further rotation of the interior handle 56 retracts the latch 30 to allow the user to exit the door. Therefore, the user can open the door by rotating the interior handle 56 when the lock assembly 20 is locked (i.e., 'emergency egress') and the lock assembly 20 becomes unlocked when the user rotates the interior handle 56 to retract the latch 30, thereby providing a non-lockout feature.

Various features and advantages of the invention are set forth in the following claims.

What is claimed is:

1. A lock assembly for use with a latch movable from an extended position to a retracted position, the lock assembly comprising:

an interior assembly including, an interior handle, a push button assembly manually movable from an unlocked position to a locked position, a biasing member that biases the push button assembly toward the unlocked position, a retaining member that engages both the push button assembly and a lock member to retain the push button assembly in the locked position, an exterior assembly including an exterior handle;

a driver rotatable from a locked position to an unlocked position such that the exterior handle is manually operable to retract the latch when the driver is in the unlocked position and inoperable to retract the latch when the driver is in the locked position; and a cam member coupled to the driver for rotation with the driver, wherein the push button assembly engages the cam member to rotate the driver toward the locked position when the push button assembly moves from the unlocked position toward the locked position and the push button assembly engages the cam member to rotate the driver toward the unlocked position when the push button assembly moves from the locked position toward the unlocked position, wherein the push button assembly includes a cam surface, wherein the cam member includes a cam surface, and wherein the cam surface of the push button assembly contacts the cam surface of the cam member to rotate the driver toward the locked position.

2. The lock assembly of claim 1, wherein rotation of the interior handle disengages the retaining member to allow the biasing member to move the push button assembly toward the unlocked position thereby rotating the driver toward the unlocked position.

3. The lock assembly of claim 1, wherein when the retaining member engages the push button assembly and the lock member, the retaining member interconnects the push button assembly and the interior handle.

4. The lock assembly of claim 1, wherein the exterior assembly further includes a lock cylinder configured to receive a key, wherein the driver is coupled to the lock cylinder such that rotation of the key rotates the driver from the locked position toward the unlocked position.

5. The lock assembly of claim 4, wherein the cam member includes a push button engaging surface, and wherein rotation of the driver from the locked position toward the unlocked position rotates the cam member such that the push button engaging surface contacts the push button assembly to rotate the push button assembly thereby disengaging the retaining member to allow the biasing member to move the push button assembly toward the unlocked position.

6. The lock assembly of claim 5, wherein the push button assembly includes a projection that extends at least partially through an aperture of the lock assembly, the aperture having an inner dimension larger than an outer dimension of the projection thereby allowing a limited amount of rotation of the push button assembly.

7. The lock assembly of claim 1, wherein the push button assembly includes a cam follower, wherein the cam surface of the cam member is a first cam surface, wherein the cam member includes a second cam surface, and wherein the cam follower contacts the second cam surface to rotate the cam member and the driver toward the unlocked position as the push button assembly moves from the locked position toward the unlocked position.

8. The lock assembly of claim 1, wherein the lock assembly includes a chassis, and wherein the exterior assembly further includes a locking member that interconnects the exterior handle and the chassis such that the exterior handle is inoperable to retract the latch when the driver is in the locked position.

9. The lock assembly of claim 1, wherein the cam member includes an aperture that receives the driver to directly couple the cam member to the driver for rotation with the driver.

10. The lock assembly of claim 1, wherein the retaining member is at least partially housed within the push button assembly.

11. A lock assembly for use with a latch movable from an extended position to a retracted position, the lock assembly comprising:

a driver rotatable from a locked position to an unlocked position;

an interior assembly including, a push button assembly manually movable from an unlocked position to a locked position and operable to rotate the driver from the unlocked position to the locked position, a biasing member that biases the push button assembly toward the unlocked position, a retaining member that engages both the push button assembly and a lock member to retain the push button assembly in the locked position, an exterior assembly including, an exterior handle manually operable to retract the latch when the driver is in the unlocked position and inoperable to retract the latch when the driver is in the locked position, a lock cylinder configured to receive a key and coupled to the driver, the lock cylinder and the key operable to rotate the driver from the locked position toward the unlocked position, wherein rotation of the driver from the locked position to the unlocked position disengages the retaining member such that the biasing member moves the push button assembly from the locked position to the unlocked position.

12. The lock assembly of claim 11, wherein rotation of the interior handle disengages the retaining member to allow the biasing member to move the push button assembly toward the unlocked position thereby rotating the driver toward the unlocked position.

13. The lock assembly of claim 11, wherein when the retaining member engages the push button assembly and the lock member, the retaining member interconnects the push button assembly and the interior handle assembly such that the push button assembly is inhibited from moving toward the unlocked position.

14. The lock assembly of claim 11, further comprising a cam member coupled to the driver for rotation with the driver, wherein the push button assembly engages the cam member to rotate the driver toward the locked position when the push button assembly moves from the unlocked position toward the locked position and the push button assembly engages the cam member to rotate the driver toward the unlocked position when the push button assembly moves from the locked position toward the unlocked position, wherein the cam member includes a push button engaging surface, and wherein rotation of the driver from the locked position toward the unlocked position by the lock cylinder rotates the cam member such that the push button engaging surface contacts the push button assembly to rotate the push button assembly thereby disengaging the retaining member to allow biasing member to move the push button assembly toward the unlocked position.

15. The lock assembly of claim 14, wherein the push button assembly includes a projection that extends at least partially through an aperture of the lock assembly, the aperture having an inner dimension larger than an outer dimension of the projection thereby allowing a limited amount of rotation of the push button assembly.

16. The lock assembly of claim 11, further comprising a cam member coupled to the driver for rotation with the driver, wherein the push button assembly engages the cam member to rotate the driver toward the locked position when the push button assembly moves from the unlocked position toward the locked position and the push button assembly engages the cam member to rotate the driver toward the unlocked position when the push button assembly moves from the locked position toward the unlocked position, wherein the push button assembly includes a cam surface, wherein the cam member includes a cam surface, and wherein the cam surface of the push button assembly contacts the cam surface of the cam member to rotate the cam member and the driver toward the locked position.

17. The lock assembly of claim 16, wherein the push button assembly includes a cam follower, wherein the cam surface of the cam member is a first cam surface, wherein the cam member includes a second cam surface, and wherein the cam follower contacts the second cam surface to rotate the cam member and the driver toward the unlocked position as the push button assembly moves from the locked position toward the unlocked position.

18. The lock assembly of claim 11, wherein the lock assembly includes a chassis, and wherein the exterior assembly further includes a locking member that interconnects the exterior handle and the chassis such that the exterior handle is inoperable to retract the latch when the driver is in the locked position.

19. The lock assembly of claim 11, further comprising a cam member coupled to the driver for rotation with the driver, wherein the push button assembly engages the cam member to rotate the driver toward the locked position when the push button assembly moves from the unlocked position toward the locked position and the push button assembly engages the cam member to rotate the driver toward the unlocked position when the push button assembly moves from the locked position toward the unlocked position, wherein the cam member includes an aperture that receives the driver to directly couple the cam member to the driver for rotation with the driver.

20. The lock assembly of claim 11, wherein the retaining member is at least partially housed within the push button assembly.

21. The lock assembly of claim 1, further comprising a cam assembly spaced apart from the cam member and coupled to the driver for rotation with the driver, wherein the cam assembly includes a first cam member, a second cam member, and a locking member captured between the first and second cam members, and wherein rotation of the first and second cam members with the driver causes the locking member to move along the driver between an unlocked position and a locked position.

22. The lock assembly of claim 1, wherein the lock member is a spindle coupled to the interior handle for rotation therewith, and wherein the spindle includes an aperture for receiving a portion of the retaining member to retain the push button assembly in the locked position.

23. The lock assembly of claim 22, wherein rotation of the interior handle rotates the spindle to disengage the retaining member from the aperture in the spindle, allowing the biasing member to move the push button assembly toward the unlocked position to rotate the driver toward the unlocked position.

24. The lock assembly of claim 12, wherein the lock member is a spindle coupled to the interior handle for rotation therewith, and wherein the spindle includes an aperture for receiving a portion of the retaining member to retain the push button assembly in the locked position.

25. The lock assembly of claim 24, wherein rotation of the interior handle rotates the spindle to disengage the retaining member from the aperture in the spindle, allowing the biasing member to move the push button assembly toward the unlocked position to rotate the driver toward the unlocked position.

26. The lock assembly of claim 7, wherein the second cam surface of the cam member faces away from the first cam surface of the cam member.

27. The lock assembly of claim 1, wherein the cam surface of the cam member includes a helical cam surface that extends around at least a portion of the driver.

28. The lock assembly of claim 27, wherein the cam surface of the push button includes a helical cam surface that extends around at least a portion of the driver, and wherein the helical cam surface of the push button contacts the helical cam surface of the cam member to rotate the driver toward the locked position.

29. The lock assembly of claim 28, wherein the helical cam surface of the cam member is a first helical cam surface, wherein the cam member includes a second helical cam surface that extends around at least a portion of the driver, wherein in the push button further includes a cam follower, and wherein the cam follower contacts the second helical cam surface to rotate the cam member and the driver toward the unlocked position as the push button assembly moves from the locked position toward the unlocked position.

30. The lock assembly of claim 18, wherein the locking member of the exterior assembly is movable between an unlocked position and a locked position, wherein the locking member of the exterior assembly interconnects the exterior handle and the chassis such that the exterior handle is inoperable to retract the latch when the locking member is in the locked position and the exterior handle is operable to retract the latch when the locking member is in the unlocked position, and wherein the locking member is configured to move from the locked position to the unlocked position in response to rotation of the driver from the locked position to the unlocked position.

31. The lock assembly of claim 30, wherein the interior assembly includes a cam member coupled to the driver for rotation with the driver, and wherein the push button assembly engages the cam member to rotate the driver toward the locked position when the push button assembly moves from the unlocked position toward the locked position and the push button assembly engages the cam member to rotate the driver toward the unlocked position when the push button assembly moves from the locked position toward the unlocked position.

32. The lock assembly of claim 31, wherein the exterior assembly includes a cam assembly coupled to the driver for rotation with the driver, and wherein the cam assembly of the exterior assembly engages the locking member of the exterior assembly to move the locking member between the locked position and the unlocked position in response to rotation of the driver between the locked position and the unlocked position.

* * * * *